US005362410A

United States Patent [19]

Okorodudu et al.

[11] Patent Number: 5,362,410

[45] Date of Patent: Nov. 8, 1994

[54] MULTIFUNCTIONAL ASHLESS DISPERSANTS

[75] Inventors: Abraham O. M. Okorodudu, West Deptford; Angeline B. Cardis, Florence, both of N.J.

[73] Assignee: Mobil Oil Corporation, Fairfax, Va.

[21] Appl. No.: 119,638

[22] Filed: Sep. 13, 1993

[51] Int. Cl.[5] ..... C10M 159/16

[52] U.S. Cl. ..... 282/47.5; 252/51.5 A; 252/391; 252/402; 548/211; 548/545

[58] Field of Search ..... 252/47.5, 51.5 A, 391, 252/402; 548/211, 545

[56] References Cited

U.S. PATENT DOCUMENTS 3,682,980 8/1972 Braid et al. ..... 260/396
4,689,218 8/1987 Gazzaniga et al. ..... 424/43
4,761,482 8/1988 Karol ..... 548/142
4,764,298 8/1988 Croudace ..... 252/47.5
4,857,214 8/1989 Papay et al. ..... 252/32.5
5,130,036 7/1992 Burt et al. ..... 252/32.5
5,156,757 10/1992 Migdal et al. ..... 252/47.5
5,160,649 11/1992 Cardis et al. ..... 252/47.5
5,182,036 1/1993 Okorodudu et al. ..... 252/47.5
5,186,850 2/1993 Okorodudu et al. ..... 252/47.5

*Primary Examiner*—Jacqueline V. Howard
*Attorney, Agent, or Firm*—Alexander J. McKillop; Malcolm D. Keen; Charles A. Malone

[57] ABSTRACT

The incorporation of the heterocyclic saccharin functionality into the alkenylsuccinimide dispersant structures via the Mannich alkylaminoalkylation procedure provides a class of ashless non-phosphorus dispersants with multifunctional antiwear, antioxidant and corrosion inhibiting properties in lubricant compositions.

28 Claims, No Drawings

MULTIFUNCTIONAL ASHLESS DISPERSANTS

BACKGROUND OF THE INVENTION

1. Field of the Invention

This application is directed to ashless dispersants derived from Mannich Reaction of hydrocarbyl succinimides and saccharin.

2. Description of Related Art

Alkyl- or alkenylsuccinimides are well known in the art as ashless dispersants for lubricants and fuels. Their principal function in such applications is to prevent the deleterious sludge accumulation on engine parts. Because of today's hotter running engines, the performance properties of ashless dispersants are being optimized to cope with the increased sludge formation resulting from increased thermal and oxidative degradation of lubricant formulations.

This invention is directed to novel multifunctional ashless dispersants derived from Mannich reaction of hydrocarbyl succinimides, saccharin and carbonyl compounds. See U.S. Pat. No. 5,186,850. See also U.S. Pat. Nos. 5,130,036 and 4,857,214 which disclose ashless dispersants comprising a hydrocarbyl succinimide, a mixed ester/amide, hydroxyesters and the Mannich condensation products of hydrocarbyl-substituted phenols, formaldehyde and polyamines.

Saccharin, of course has found widespread use in the sweetening art. However, U.S. Pat. No. 4,689,218 discloses an effervescent composition with analgesic activity having an artificial sweetener such as saccharin, a binder and a lubricant such as polyethylene glycol.

Today's hotter running engines require more highly dispersant oil formulas to minimize the increased sludge formation and deposits on engine parts. Consequently, in addition to increased dispersant activity, the ashless dispersants must be compatible with, and if possible, provide additional performance protection to these oil compositions. By incorporating antiwear and antioxidant functionalities into existing succinimide ashless dispersants, the chemistry of this invention has made it possible to optimize their effectiveness and also expand their application. This is especially significant in view of current and projected industry-wide efforts to minimize the concentration of, or replace, the zinc dithiophosphates (ZnDTP) which have, historically, provided the multifunctional antiwear and antioxidant protection to a large variety of lubricant formulations.

The synergistic combination of the succinimide and the sulfur-and nitrogen-containing heterocyclic saccharin functionalities in the products of this invention provides ashless dispersants with additional multifunctional antioxidant, antiwear and potential metal passivator properties for lubricant compositions. To the best of our knowledge, the syntheses and applications of this class of compounds have not been disclosed elsewhere and are, therefore, novel.

BRIEF SUMMARY OF THE INVENTION

This invention is directed to novel multifunctional ashless dispersants derived from the Mannich condensation reaction of hydrocarbyl succinimides and saccharin and to lubricant and fuel compositions containing same.

More specifically this invention is directed to a composition comprising a major proportion of an oil of lubricating viscosity or grease prepared therefrom and a minor antioxidant, load-carrying, corrosion inhibiting proportion of a non-phosphorus ashless dispersant multifunctional additive product of reaction prepared by imidation of a carboxylic anhydride with a suitable polyamine thereby providing the corresponding hydrocarbyl succinimide and thereafter in a Mannich-type post reaction said succinimide is reacted with saccharin and carbonyl compounds to give said multifunctional additive product. This invention is also directed to the additive products themselves and to the process of making same.

It is therefore an object of this invention to provide improved lubricant compositions containing multicharacteristic novel additive products of reaction prepared by a novel reaction process.

DESCRIPTION OF THE PREFERRED EMBODIMENTS

The novel reaction products in accordance with the invention are prepared in the following specific manner in order to achieve the surprising multifunctional characteristics possessed by these additive compounds.

Preparation

Dispersant alkyl- or alkenylsuccinimides are generally prepared by imidation of the corresponding anhydrides with polyamines, viz:

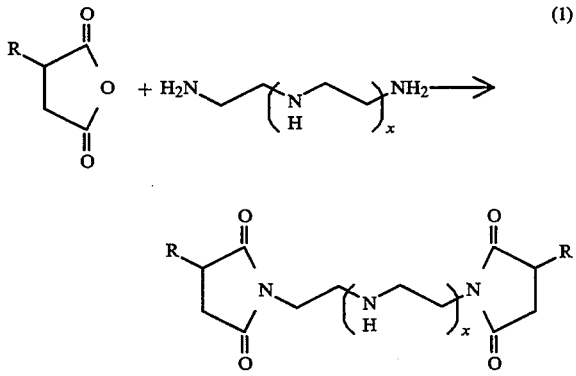

Post reaction of the preferred alkyl- or alkenylsuccinimides with saccharin and carbonyl compounds in an organic solvent such as toluene, gives the Mannich-type reaction product of this invention as exemplified in Equation 2.

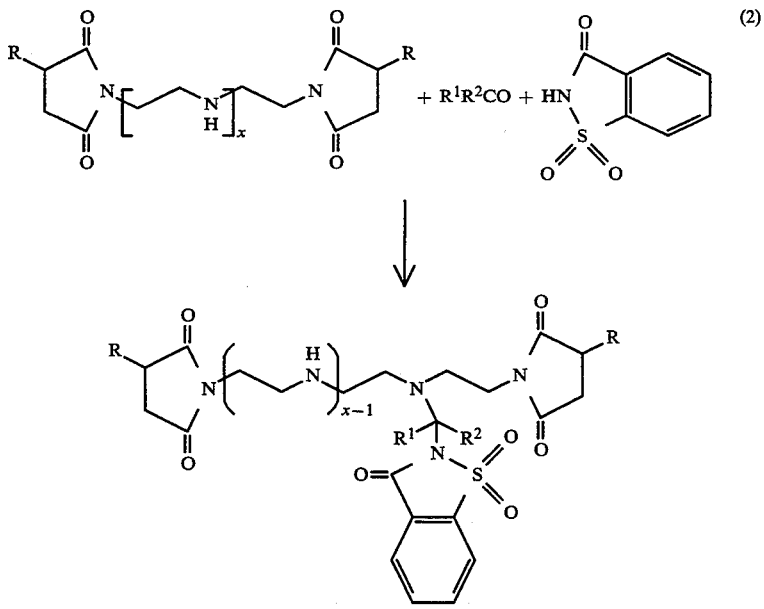

Wherein R is $C_1$ to about $C_{10,000}$ hydrocarbyl or hydrocarbenyl, and $R^1$ and $R^2$ maybe the same or different and are each hydrogen or $C_1$ to $C_{50}$ hydrocarbyl or $R^1R^2$ may be $(CH_2)_m$ comprising part of an alicyclic system where m is from 2 to about 30, and where hydrocarbyl may be $(CH_2)$m alkyl, alkenyl, aryl, aralkyl or alkaryl and also alicyclic or polycyclic moieties, and the hydrocarbyl moieties may optionally contain O, S, or N or mixtures thereof and X is an integer from 1 to about 30.

Although we do not wish to be bound by the structural formula of the reaction product of Equation 2, the resulting product is thought to contain material having such a structural formula.

Any suitable succinimide may be used in the invention provided it contains at least one basic primary amine or secondary amine. Preferred are those succinimides derived from polyisobutenylsuccinic anhydride and tetraethylenepentamine; and $C_{18}$–$C_{24}$ succinic anhydride and diethylenetriamine. The broad class of succinimides suitable for use here is particularly defined as the reaction product in Equation 1 above and more particularly be $C_4$ to about $C_{200}$ alkyl or alkenyl succinimide.

The polyamines suitable for use in preparing the succinimides include but are not limited to polyamines such as tetraethylenepentaamine, and diethylenetriamine.

Any suitable carbonyl compound may be used herein including aldehydes or ketones such as paraformaldehyde or 2-ethylhexanal. The reactant carbonyl compounds can optionally contain additional O, N, S, etc.

Conditions for the above reactions may vary widely depending upon specific reactants, the presence or absence of a solvent and the like. Any suitable set of reaction conditions known to the art may be used. Hydrocarbon solvents such as toluene or xylenes are frequently used. Generally stoichiometric or equimolar ratios of reactants are used. However, more than equimolar or less than equimolar amounts may be used. Generally speaking, the reaction temperature may vary from ambient to about 250° C. or reflux, the pressure may be autogenous or vary from ambient to about 100 psi and the preferred molar ratio of reactant succinimide, carbonyl compound and saccharin preferably varies from about 1:3:3 to about 1:1:1 moles with reaction times varying from about 1 to about 48 hours or more.

Clearly the use of these ashless dispersants derived from Mannich reaction of hydrocarbyl succinimide and saccharin provides exceptional antioxidant, load-carrying activity and corrosion inhibiting properties in lubricant compositions.

The additives embodied herein are utilized in lubricating oil or grease compositions in an amount which imparts significant antioxidant, load-carrying and corrosions inhibiting characteristics to oil or grease as well as reducing the friction of engines operating with the oil in its crankcase. Concentrations of about 0.001 to about 10 wt. % based on the total weight of the composition can be used. Preferably, the concentration is from 0.1 to about 3 wt. %. It is expected that these materials would also be suitable for use in liquid hydrocarbyl or hydrocarbyloxy or oxygenated or alcoholic fuels or mixed hydrocarbyl/alcoholic or oxygenated/alcoholic fuel compositions.

The additives have the ability to improve the antiwear characteristics and friction reducing characteristics of various oleagenous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SUS at 100° F. to about 6,000 SUS at 100° F. and preferably, from about 50 to about 250 SUS at 210° F. These oils may have viscosity indexes ranging to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any materials which is normally employed for thickening or gelling hydrocarbon fluids for forming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether.

It is to be understood, however, that the compositions contemplated herein can also contain other materials. For example, corrosion inhibitors, extreme pressure agents and the like can be used as exemplified respectively by metallic phenates sulfonates, polymeric succinimides, non-metallic or metallic phosphorodithioates and the like. These materials do not detract from the value of the compositions of this invention, rather the materials serve to impart their customary properties to the particular compositions in which they are incorporated.

The following examples are merely illustrative and are not meant to be limitations on the scope of this invention.

EXAMPLE 1

Equimolar amounts (0.1 moles each) of an alkenylsuccinimide [obtained from the post reaction of 920 m.w. polyisobutenylsuccinic anhydride with tetraethylenepentaamine (TEPA)], and saccharin were charged into a 1 liter reaction flask equipped with a Dean Stark trap and an addition funnel. Xylene, 150 ml, was added to this mixture which was then stirred and heated to reflux. An equimolar amount of 2-ethylhexanal was then added dropwise at reflux. Reflux was maintained for about 4 hours during which time about 2 ml of water was collected. After stripping the solvent at reduced pressure, a quantitative yield of the product was obtained as a dark brown oil.

The reaction can be run with other polyamine-derived bis- or monoalkyl- or alkenylsuccinimides which contain at least one basic primary or secondary amine, in other aprotic solvents such as hexanes, xylenes, ethers, etc. Similarly, other carbonyl compounds such as ketones and aldehydes may be used. The reactant carbonyl compounds can optionally contain additional O, N, S, etc.

Following the procedure of Example 1 but varying the alkenylsuccinic anhydrides and/or the reactant carbonyl compounds, the products of the following examples were prepared mostly in quantitative yields.

EXAMPLE 2

The same alkenylsuccinimide as in Example 1 was used and paraformaldehyde was the reactant carbonyl compound in the preparation of this product.

EXAMPLE 3

The product of this reaction was prepared in essentially quantitative yield by post reaction of equimolar amount of an alkenylsuccinimide [obtained as a 920 m.w. polyisobutenylsuccinic anhydride-ether diamine (Exxon's DA-25) adduct] with paraformaldehyde and saccharin.

EXAMPLE 4

This product was obtained by reacting equimolar amounts of a $C_{18}$–$C_{24}$ alkenylsuccinimide [obtained as a $C_{18}$–$C_{24}$ succinic anhydride-etherdiamine (Exxon's ether diamine, DA-25) adduct], paraformaldehyde and saccharin.

EXAMPLE 5

This product was obtained by reacting equimolar amounts of a $C_{18}$–$C_{24}$alkenylsuccinimide [obtained as a $C_{18}$–$C_{24}$ succinic anhydride-diethylenetriamine (DETA) adduct], 2-ethylhexanal and saccharin.

EXAMPLE 6

Equimolar amounts of the reactant alkenylsuccinimide [obtained as a 920 m.w. polyisobutenylsuccinic anhydride-ether diamine (Exxon's DA-17) adduct], paraformaldehyde and saccharin were used in the preparation of this product.

EXAMPLE 7

Following the same reaction conditions as above, the product of this example was obtained from the reaction of equimolar amounts of an alkenylsuccinimide [obtained as a 920 m.w. polyisobutenylsuccinic anhydride-diethylenetriamine (DETA) adduct], paraformaldehyde and saccharin.

EXAMPLE 8

This product was obtained by using a $C_{18}$–$C_{24}$ alkenylsuccinimide [obtained as a $C_{18}$–$C_{24}$ succinic anhydride-N-Tallow-1,3 Diaminopropane (Akzo's Duomeen T) adduct], paraformaldehyde and saccharin.

Evaluation

The additives were blended (1%) into a solvent refined paraffinic neutral base stock and tested for antioxidant effectiveness by Catalytic Oxidation Test (Mobil Method 334-2) and in the standard Four-Ball Wear test machine for antiwear activity. They were also blended (4%) in a 13 TBN Railroad Type Engine Oil and tested for antioxidant performance by Mobil Method 334-10. The conditions of the tests, results and comparison of the above samples with base oils and commercial samples are shown in Tables 1, 2, and 3 below.

The Catalytic Oxidation Test reported in Tables 1 and 2 may be summarized as follows: Basically the lubricant is subjected to a stream of air which is bubbled through the oil formulation at the rate of five liters per hour at 325 degrees F. for 40 hours or at 375 degrees F. for 24 hours. Present in the composition are samples of metals commonly used in engine construction, namely iron, copper, aluminum and lead, see U.S. Pat. No. 3,682,980 incorporated herein by reference for further details of the test.

The Copper Strip Corrosivity Test (ASTM D-130) (as reported in Table 1) measures a product's propensity to corrode copper due to, for example, contained sulfur groups. Further details may be found in ASTM Standards on Petroleum Products and Lubricants, published annually by the American Society for testing Materials.

In the Four Ball Wear Test (as reported in Table 3) three stationary balls are placed in a lubricant cup and a lubricant containing the compound to be tested is added thereto, and a fourth ball is placed in a chuck mounted on a device which can be used to spin the ball at known speeds and loads. The examples were tested using half inch stainless steel balls of 52100 steel for thirty minutes under 60 kg load at 2000 rpm and 200 degrees F. If additional information concerning this test is desired, consult test method ASTM D2266 and/or U.S. Pat. No. 4,761,482.

K (as reported in Table 3) the wear coefficient is calculated from the wear volume, V, of the stationary ball.

Wear Coefficient $K$

Dimensionless $K$ is defined as $K = \frac{VH}{dW}$ where

V=wear volume, mm 3

H=hardness 725 kg/mm 2 for 52100 steel d=(23.3 mm/rev) (RPM×Time)

W=(0.408) (Load in kg)

The wear volume V will be calculated from the wear scar diameter D in mm as follows:

$$V=[15.5D3-0.0103L]D\times 10(-3)mm\ 3$$

where L is the machine load in kg. This equation considers the elastic deformation of the steel balls. For a 60 kg load, the equation is $$V=[15.5D3-0.618]D\times 10(-3)mm\ 3$$

TABLE 1

Catalytic Oxidation Test (M334-2) 40 Hrs. at 325° F.

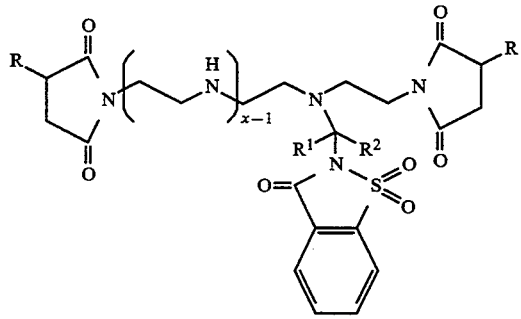

A

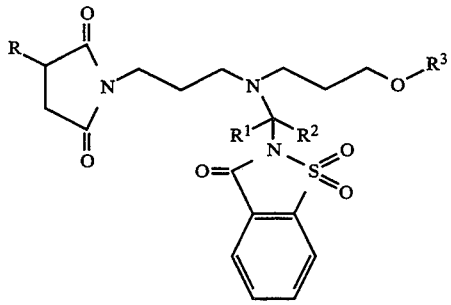

B

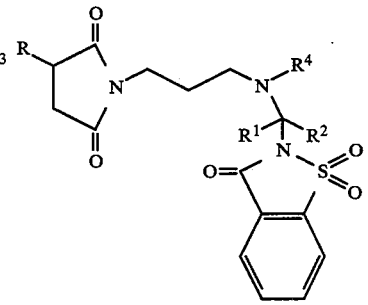

C

| Item | Additive (1% conc.) | % Viscosity Change (% ΔKV) | Change in Acidity (ΔNN) | Corrosivity D130-6 |
|---|---|---|---|---|
| 1 | None (Base Oil, solvent refined paraffinic neutral mineral oil) | 300 | 16 | 1A |
| 2 | Proprietary Ashless Dispersant (underivatized) bis succinimide) | 152.5 | 8.0 | 1A |
| 3 | Example 1: (item 2 derivatized) A: R = 920 m.w. PIB $R^1$ = H; $R^2$ = $C_7H_{15}$; x = 3 | 2.7 | 0.8 | 1A |
| 4 | Example 2: (item 2 derivatized) A: R = 920 m.w. PIB $R^1$ = $R^2$ = H; x = 3 | 72.4 | 3.6 | 1A |

TABLE 1-continued

Catalytic Oxidation Test (M334-2) 40 Hrs. at 325° F.

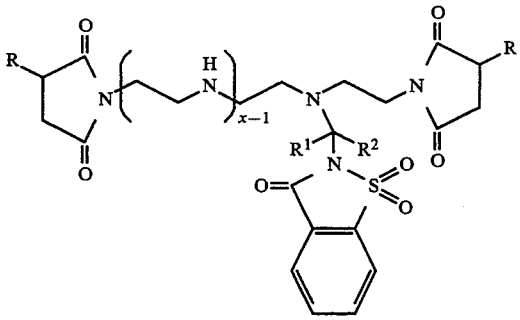

A

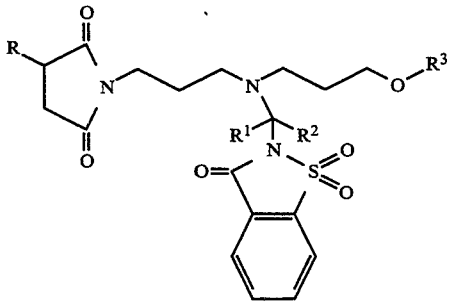

B

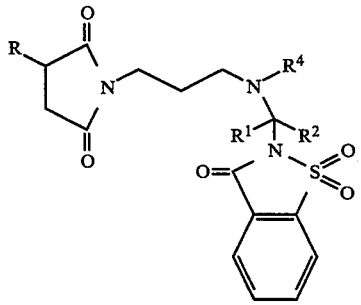

C

| Item | Additive (1% conc.) | % Viscosity Change (% ΔKV) | Change in Acidity (ΔNN) | Corrosivity D130-6 |
|---|---|---|---|---|
| 5 | Example 3: B: R = 920 m.w. PIB $R^1 = R^2 = H$ $R^3 = C_{21}H_{43}$ | 12.6 | 3.1 | 1A |
| 6 | Example 4: B: R = $C_{18}C_{24}$ $R^1 = R_2 = H$ $R^3 = C_{12}H_{43}$ | 40.3 | 7.8 | 1A |
| 7 | Example 5: A: R = $C_{18}$–$C_{24}$ $R^1$ = H: $R^2 = C_7H_{15}$; x = 1 | 66.8 | 4.7 | 1A |
| 8 | Example 6: B: R = 920 m.w. PIB $R^1 = R^2 = H$ $R^3 = C_{13}H_{27}$ | 73.4 | 4.2 | 1A |

TABLE 2

Catalytic Oxidation Test (M334-10) 24 Hrs., 375°

| Item | Additive (4% conc.) | % Viscosity Change (% ΔKV) | Change in Acidity (ΔNN) |
|---|---|---|---|
| 1 | None (13 TBN Railroad Type Engine Oil) | 131.4 | 7.5 |
| 2 | Example 1: A: R = 920 m.w. PIB $R^1$ = H; $R^2 = C_7H_{15}$; x = 3 | 68.2 | 5.3 |
| 3 | Example 7: A: R = 920 m.w. PIB $R^1 = R^2$ = H; x = 1 | 56.6 | 3.8 |
| 4 | Example 8: C: R = $C_{18}$–$C_{24}$ $R^1 = R^2 = H$ $R^4$ = Tallow Alkyls | 58.2 | 3.2 |

The above tables show that the ashless dispersant examples of this invention provide very good antioxidant protection to the base lubricant composition as demonstrated by the control of viscosity and acidity. Table 1, further shows the superior performance of item 3, (example 1) over its precursor, item 2, clearly demonstrating the performance advantage provided by derivatizing the succinimide dispersants of this invention. Also the corrosivity rating on table shows the metal surface passivator properties and the non-corrosive nature of the products of this invention.

TABLE 3

Four-Ball Wear Test

½" Balls, 52100 Steel, 60 Kg, 2000 RPM, 200° F., 30 min.

| Item | Additive (1%) | Wear Scar Diam (mm) | K Factor |
|---|---|---|---|
| 1 | None (Base Oil) (80% solvent refined paraffinic bright oil, 20% solvent refined paraffinic neutral oil) | 1.49 | 266.1 |
| 2 | Proprietary Ashless Dispersant (Underivatized bis succinimide) | 1.74 | 496.6 |
| 3 | Example 1: (item #2 derivatized) A: R = 920 m.w. PIB $R^1$ = H; $R^2 = C_7H_{15}$; x = 3 | 0.47 | 2.0 |
| 4 | Example 2: (item #2 derivatized) A: R = 920 m.w. PIB $R^1 = R^2$ = H; x = 3 | 0.484 | 2.3 |

TABLE 3-continued

| Four-Ball Wear Test ½" Balls, 52100 Steel, 60 Kg, 2000 RPM, 200° F., 30 min. | | | |
|---|---|---|---|
| Item | Additive (1%) | Wear Scar Diam (mm) | K Factor |
| 5 | Example 7: A: R = 920 m.w. PIB | 0.481 | 2.2 |
| | $R^1 = R^2 = H$; x 1 | | |
| 6 | Example 6: B: R = 920 m.w. PIB $R^1 = R^2 = H$ $R^3 = C_{13}H_{27}$ | 0.503 | 2.8 |
| 7 | Example 3: B: R = 920 m.w. PIB $R^1 = R^2 = H$ $R^3 = C_{21}H_{43}$ | 0.516 | 3.1 |

The above table shows that the ashless dispersant products of this invention provide excellent antiwear protection to the lubricant composition, and again the superior performance of items 3 and 4 (Example 1 and 2, respectively) over their precursor, Item 2, clearly demonstrates the beneficial effects of this chemistry.

In addition, the ashless and non-phosphorus products of this invention do not contain any environmentally and toxicologically undesirable metals or other potentially undesirable materials. Furthermore, existing technology and reactant raw materials are available to facilitate the preparation and production of this class of additives.

Although the present invention has been described with preferred embodiments, it is to be understood that modifications and variations may be resorted to, without departing from the spirit and scope of this invention, as those skilled in the art will readily understand. Such variations and modifications are considered within the purview and scope of the appended claims.

We claim:

1. An improved lubricant composition comprising a major amount of an oil of lubricating viscosity or a grease prepared therefrom and a minor amount of a non-phosphorus, ashless dispersant multifunctional antioxidant, load-carrying and corrosion inhibiting additive product of reaction prepared by (a) imidation of an anhydride with a polyamine to obtain the corresponding dispersant hydrocarbyl succinimide and (b) reacting in a Mannich-type post reaction said succinimide with saccharin and a carbonyl compound to obtain the desired additive product of reaction.

2. The composition of claim 1 wherein said desired additive product of reaction is prepared as described below:

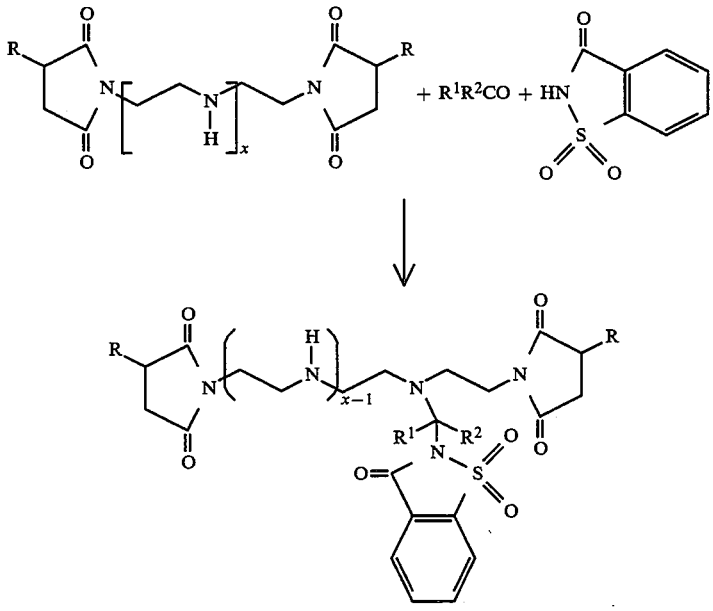

where R is $C_1$ to about $C_{10,000}$ hydrocarbyl or hydrocarbenyl, and $R^1$ and $R^2$ are each hydrogen or $C_1$ to about $C_{50}$ hydrocarbyl or $R^1R^2$ may be $(CH_2)_m$ comprising part of an alicyclic system where m is from 2 to about 30, and where hydrocarbyl may be alkyl, alkenyl, aryl, aralkyl or alkaryl and also alicyclic or polycyclic moieties, and the hydrocarbyl moieties may optionally contain O, S, or N or mixtures thereof and X is an interger from 1 to about 30 and wherein the reaction is carried out at temperatures varying from ambient to about 250° C. under pressures varying from ambient to about 100 psi or is autogenous for a time sufficient to obtain the desired additive product of reaction varying from about 1 to about 48 hours and where the reaction is carried out in molar ratios of reactants varying from equimolar to more than molar to less than molar.

3. The composition of claim 1 wherein the reactants are 920 m.w. polyisobutenylsuccinic anhydride, tetraethylenepentamine, saccharin and 2-ethylhexanal.

4. The composition of claim 1 wherein the reactants are 920 m.w. polyisobutenylsuccinic anhydride, tetraethylenepentamine, saccharin and paraformaldehyde.

5. The composition of claim 1 wherein the reactants are 920 m.w. polyisobutenylsuccinic anhydride, ether diamine, paraformaldehyde and saccharin.

6. The composition of claim 1 wherein the reactants are a $C_{18}$–$C_{24}$ alkenylsuccinic anhydride, ether diamine, paraformaldehyde, and saccharin.

7. The composition of claim 1 wherein the reactants are a $C_{18}$–$C_{24}$ alkenylsuccinic anhydride, diethylenetriamine, 2-ethylhexanal, and saccharin.

8. The composition of claim 1 wherein the reactants are a 920 m.w. polyisobutenylsuccinic anhydride, diethylenetriamine, paraformaldehyde and saccharin.

9. The composition of claim 1 wherein the lubricant is an oil of lubricating viscosity selected from the group consisting of (1) mineral oils, (2) synthetic oils, (3) or mixtures of mineral and synthetic oils or is (4) a grease prepared from any one of (1) , (2) or (3).

10. The composition of claim 9 wherein the lubricant contains from about 0.001 to about 10 wt % based on the total weight of the composition of the additive product of reaction.

11. The composition of claim 9 wherein the lubricant is a mineral oil.

12. A process of preparing a non-phosphorus, ashless dispersant multifunctional antioxidant, load-carrying and corrosion inhibiting additive product comprising (1) imidation of a hydrocarbyl anhydride with a polyamine to obtain the corresponding hydrocarbyl succinimide and (2) reacting in a Mannich reaction said succinimide with saccharin and a carbonyl compound to obtain the desired additive product of reaction.

13. The process of claim 12 wherein said additive product is prepared as described below:

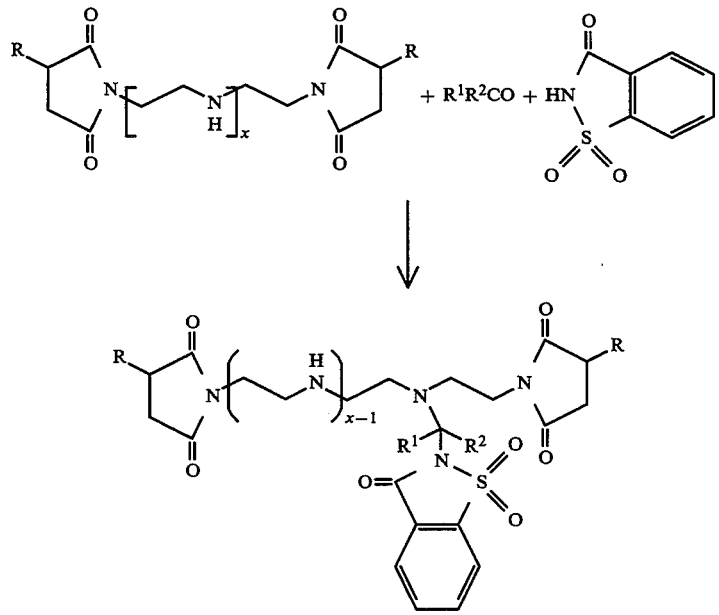

where R is $C_1$ to about $C_{10,000}$ hydrocarbyl or hydrocarbenyl, and $R^1$ and $R_2$ are hydrogen or $C_1$ to about $C_{50}$ hydrocarbyl or $R^1R^2$ may be $(CH_2)_m$ comprising part of an alicyclic system where m is from 2 to about 30, and where hydrocarbyl may be alkyl, alkenyl, aryl, aralkyl or alkaryl and also alicyclic or polycyclic moieties, and the hydrocarbyl moieties may optionally contain O, S, or N or mixtures thereof and X is an interger from 1 to about 30 and wherein the reaction is carried out at temperatures varying from ambient to about 250° C. under pressures varying from ambient to about 100 psi or is autogenous for a time sufficient to obtain the desired additive product of reaction varying from about 1 to about 48 hours and where the reaction is carried out in molar ratios of reactants varying from equimolar to more than molar to less than molar.

14. The process of claim 12 wherein the reactants are 920 m.w. polyisobutenylsuccinic anhydride, tetraethylenepentamine, saccharin and 2-ethylhexanal.

15. The process of claim 12 wherein the reactants are polyisobutenylsuccinic anhydride, tetraethylenepentamine, saccharin and paraformaldehyde.

16. The process of claim 12 wherein the reactants are 920 m.w. polyisobutenylsuccinic anhydride, ether diamine, paraformaldehyde and saccharin.

17. The process of claim 12 wherein the reactants are a $C_{18}$–$C_{24}$ alkenylsuccinic anhydride, ether diamine, paraformaldehyde, and saccharin.

18. The process of claim 12 wherein the reactants are a $C_{18}$–$C_{24}$ alkenylsuccinic anhydride, diethylenetriamine, 2-ethylhexanal, and saccharin.

19. The process of claim 12 wherein the reactants are a 920 m.w. polyisobutenylsuccinic anhydride, diethylenetriamine, paraformaldehyde and saccharin.

20. A method of preparing an improved lubricant composition comprising adding to said lubricant a minor multifunctional antioxidant, load-carrying, corrosion-inhibiting amount of from about 0.001 to about 10 wt % based on the total weight of the composition of an additive product of reaction comprising an ashless dispersant derived from the Mannich reaction of a hydrocarbyl succinimide with a carbonyl compound and saccharin.

21. A non-phosphorus, ashless dispersant lubricant additive product of reaction having multifunctional antioxidant, load-carrying and corrosion inhibiting properties prepared by (a) imidation of an hydrocarbyl anhydride with a polyamine to obtain the corresponding hydrocarbyl succinimide and (b) reacting in a Mannich reaction said succinimide with saccharin and a carbonyl compound to obtain the desired additive product of reaction and wherein the reaction is carried out at temperatures varying from ambient to about 250° C. under autogenous pressure or pressures varying from ambient to about 100 psi for a time sufficient to obtain the desired additive product of reaction varying from about one hour to about 48 hours and where the reaction is carried out in molar ratios of reactants varying from equimolar to more than equimolar to less than equimolar.

22. The product of claim 21 wherein said desired additive product of reaction is prepared as described below:

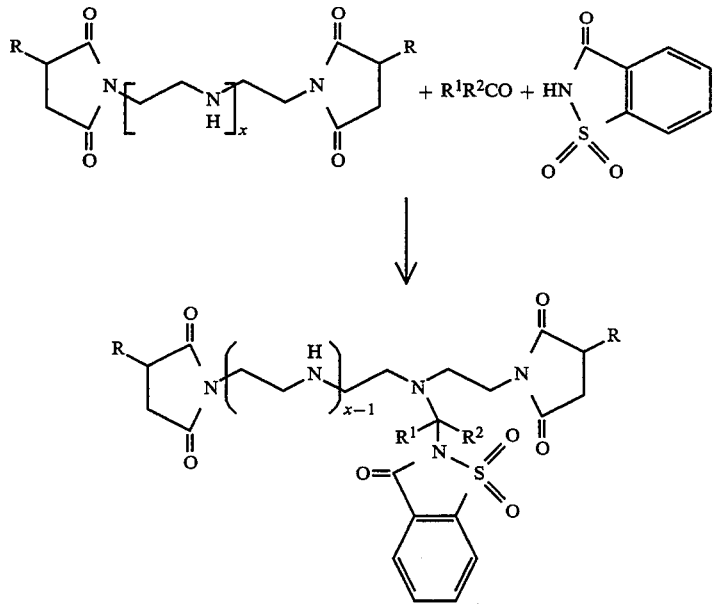

where R is $C_1$ to about $C_{10,000}$ hydrocarbyl or hydrocarbenyl, and $R^1$ and $R^2$ are hydrogen or $C_1$ to about $C_{50}$ hydrocarbyl and $R^1R^2$ may be $(CH_2)_m$ comprising part of an alicyclic system where m is from 2 to about 30, and where hydrocarbyl may be alkyl, alkenyl, aryl, aralkyl or alkaryl and also alicyclic or polycyclic moieties, and the hydrocarbyl moieties may optionally contain O, S, or N or mixtures thereof and X is an integer from 1 to about 30.

23. The product of claim 21 wherein the reactants are 920 m.w. polyisobutenylsuccinic anhydride, tetraethylenepentamine, saccharin and 2-ethylhexanal.

24. The product of claim 21 wherein the reactants are polyisobutenylsuccinic anhydride, tetraethylenepentamine, saccharin and paraformaldehyde.

25. The product of claim 21 wherein the reactants are 920 m.w. polyisobutenylsuccinic anhydride, ether diamine, paraformaldehyde and saccharin.

26. The product of claim 21 wherein the reactants are a $C_{18}$–$C_{24}$ alkenylsuccinic anhydride, ether diamine, paraformaldehyde, and saccharin.

27. The product of claim 21 wherein the reactants are a $C_{18}$–$C_{24}$ alkenylsuccinic anhydride, diethylenetriamine, 2-ethylhexanal, and saccharin.

28. The product of claim 21 wherein the reactants are a 920 m.w. polyisobutenylsuccinic anhydride, diethylenetriamine, paraformaldehyde and saccharin.

* * * * *

UNITED STATES PATENT AND TRADEMARK OFFICE

CERTIFICATE OF CORRECTION

PATENT NO. : 5,362,410

DATED : November 8, 1994

INVENTOR(S) : A. O. M. Okorodudu et al.

It is certified that error appears in the above-indentified patent and that said Letters Patent is hereby corrected as shown below:

In Column 12, line 2, delete "-type post"

Signed and Sealed this

Twenty-fourth Day of January, 1995

*Attest:*

Bruce Lehman

BRUCE LEHMAN

*Attesting Officer*

*Commissioner of Patents and Trademarks*